US010959595B2

(12) United States Patent
Diedrichs

(10) Patent No.: US 10,959,595 B2
(45) Date of Patent: Mar. 30, 2021

(54) DEBRIS COLLECTION DEVICE

(71) Applicant: John Diedrichs, Wall, SD (US)

(72) Inventor: John Diedrichs, Wall, SD (US)

( * ) Notice: Subject to any disclaimer, the term of this patent is extended or adjusted under 35 U.S.C. 154(b) by 125 days.

(21) Appl. No.: 16/218,540

(22) Filed: Dec. 13, 2018

(65) Prior Publication Data

US 2020/0187744 A1 Jun. 18, 2020

(51) Int. Cl.

| | |
|---|---|
| ***A47L 13/258*** | (2006.01) |
| *A46B 9/06* | (2006.01) |
| *B25G 1/10* | (2006.01) |
| *A46B 5/00* | (2006.01) |
| *A46B 5/02* | (2006.01) |

(52) U.S. Cl.

CPC ..... *A47L 13/258* (2013.01); *A46B 5/0033* (2013.01); *A46B 5/02* (2013.01); *A46B 9/06* (2013.01); *A46B 2200/302* (2013.01); *B25G 1/102* (2013.01)

(58) Field of Classification Search

CPC ..... A47L 13/258; A46B 5/0033; A46B 5/02; A46B 9/06; A46B 2200/302; B25G 1/102

See application file for complete search history.

(56) References Cited

U.S. PATENT DOCUMENTS 4,637,087 A * 1/1987 Feinberg ..... E04H 4/1609 15/1.7
4,809,388 A 3/1989 Dietrich
4,882,802 A * 11/1989 LeVere, Jr. ..... A46B 5/0054 15/144.1
5,873,148 A * 2/1999 Arnold ..... B25G 1/043 16/422
5,920,944 A 7/1999 Biggs
5,943,727 A 8/1999 Freer
6,199,241 B1 * 3/2001 Anumah ..... A46B 9/02 15/145
6,393,647 B1 * 5/2002 Libman ..... A46B 5/0095 15/145
6,477,732 B1 11/2002 Cline
6,487,746 B1 12/2002 Cioci
6,634,822 B1 * 10/2003 Wang ..... A46B 11/063 15/144.4
8,528,146 B1 * 9/2013 Abrahamson ..... A46B 5/0045 15/1.7

(Continued)

FOREIGN PATENT DOCUMENTS

| | | |
|---|---|---|
| AU | 2017204834 | 2/2017 |
| CN | 106889961 | 1/2017 |
| JP | 2005270440 | 10/2005 |

*Primary Examiner* — Weilun Lo

(57) ABSTRACT

A debris collection device for sweeping up residual grain in a bin includes a plate, a plurality of bristles, and a stick. The plate is elongated rectangularly shaped and comprises a first section, which is planar, and second section, which is curved. The bristles are coupled to and extend from a lower face of the plate. The stick is coupled to and extends from an upper face of the plate. The stick is configured to be grasped in hands of a user, positioning the user to urge the bristles that are positioned on the first section across a first surface with the bristles positioned on the second section configured to contact a second surface that is positioned substantially perpendicular to the first surface to collect debris that is positioned on the first surface.

17 Claims, 8 Drawing Sheets

(56) References Cited

U.S. PATENT DOCUMENTS

| | | | | |
|---|---|---|---|---|
| 9,049,918 | B2 | 6/2015 | Perelli | |
| 9,303,414 | B1 | 4/2016 | Keiser | |
| 10,188,200 | B1 * | 1/2019 | Hetzner | A46B 5/0095 |
| 2003/0180085 | A1 * | 9/2003 | Hughes | A01B 1/227<br>401/289 |
| 2007/0180639 | A1 * | 8/2007 | Libman | B25G 3/06<br>15/145 |
| 2007/0266510 | A1 * | 11/2007 | Weaver | A46B 15/0055<br>15/117 |
| 2008/0066244 | A1 | 3/2008 | Noble | |
| 2009/0172903 | A1 * | 7/2009 | Vosbikian | A47L 13/12<br>15/172 |
| 2009/0235476 | A1 | 9/2009 | Cioci | |
| 2011/0119846 | A1 * | 5/2011 | Stokes | A46B 17/02<br>15/105 |
| 2011/0308025 | A1 * | 12/2011 | Vosbikian | A46B 5/0008<br>15/105 |
| 2013/0269131 | A1 * | 10/2013 | Mallett | B25G 1/102<br>15/144.1 |
| 2013/0291327 | A1 * | 11/2013 | Perez | A46B 9/00<br>15/171 |
| 2014/0158151 | A1 | 6/2014 | Sebagereka | |
| 2016/0022021 | A1 * | 1/2016 | Kurani | A46B 5/0054<br>15/172 |

* cited by examiner

DEBRIS COLLECTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to collection devices and more particularly pertains to a new collection device for sweeping up residual grain in a bin.

BRIEF SUMMARY OF THE INVENTION

An embodiment of the disclosure meets the needs presented above by generally comprising a plate, a plurality of bristles, and a stick. The plate is elongated rectangularly shaped and comprises a first section, which is planar, and second section, which is curved. The bristles are coupled to and extend from a lower face of the plate. The stick is coupled to and extends from an upper face of the plate. The stick is configured to be grasped in hands of a user, positioning the user to urge the bristles that are positioned on the first section across a first surface with the bristles positioned on the second section configured to contact a second surface that is positioned substantially perpendicular to the first surface to collect debris that is positioned on the first surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
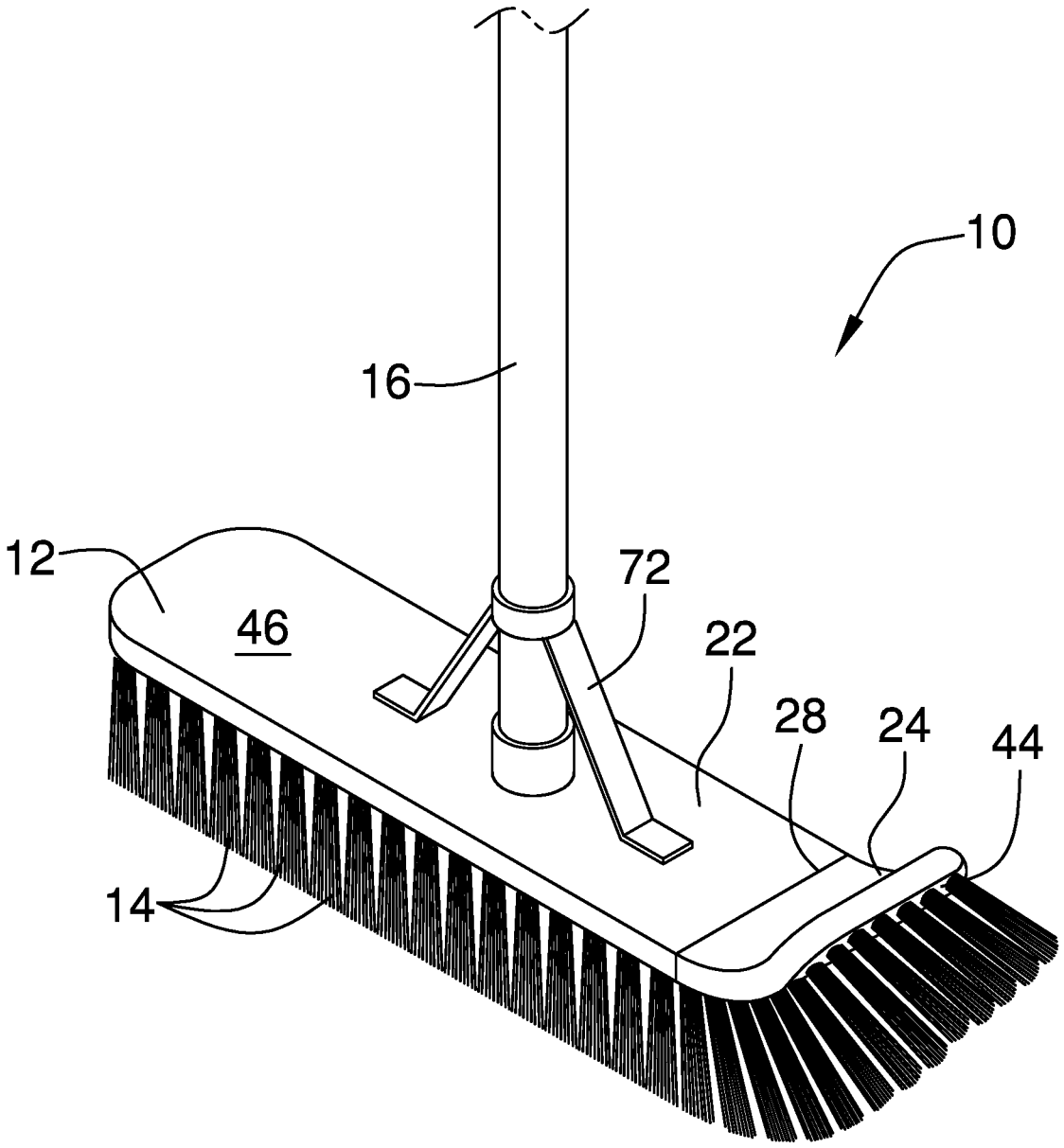
FIG. 1 is an isometric perspective view of a debris collection device according to an embodiment of the disclosure.

With reference now to the drawings, and in particular to FIGS. 1 through 8 thereof, a new collection device embodying the principles and concepts of an embodiment of the disclosure and generally designated by the reference numeral 10 will be described.

As best illustrated in FIGS. 1 through 8, the debris collection device 10 generally comprises a plate 12, a plurality of bristles 14, and a stick 16. The plate 12, which is elongated rectangularly shaped, comprises a first section 22, which is planar, and second section 24 that is curved. The plate 12 has corners 26 that are arcuate. The plate 12 comprises at least one of wood, metal, and plastic.

In another embodiment, as shown in FIGS. 1-6, a separation 28 is positioned between the second section 24 and the first section 22 of the plate 12 to define a first joining surface 30, which is positioned on the first section 22, and a second joining surface 32 that is positioned on the second section 24. A first connector 86 is coupled to the first joining surface 30. A second connector 34 is coupled to the second joining surface 32. The second connector 34 is complementary to the first connector 86 so that the second connector 34 is positioned to reversibly couple to the first connector 86 to removably couple the second section 24 to the first section 22. As such, the second section 24 can be detached and reattached to the first section 22 as required to meet requirements of a user.

Figure 3:
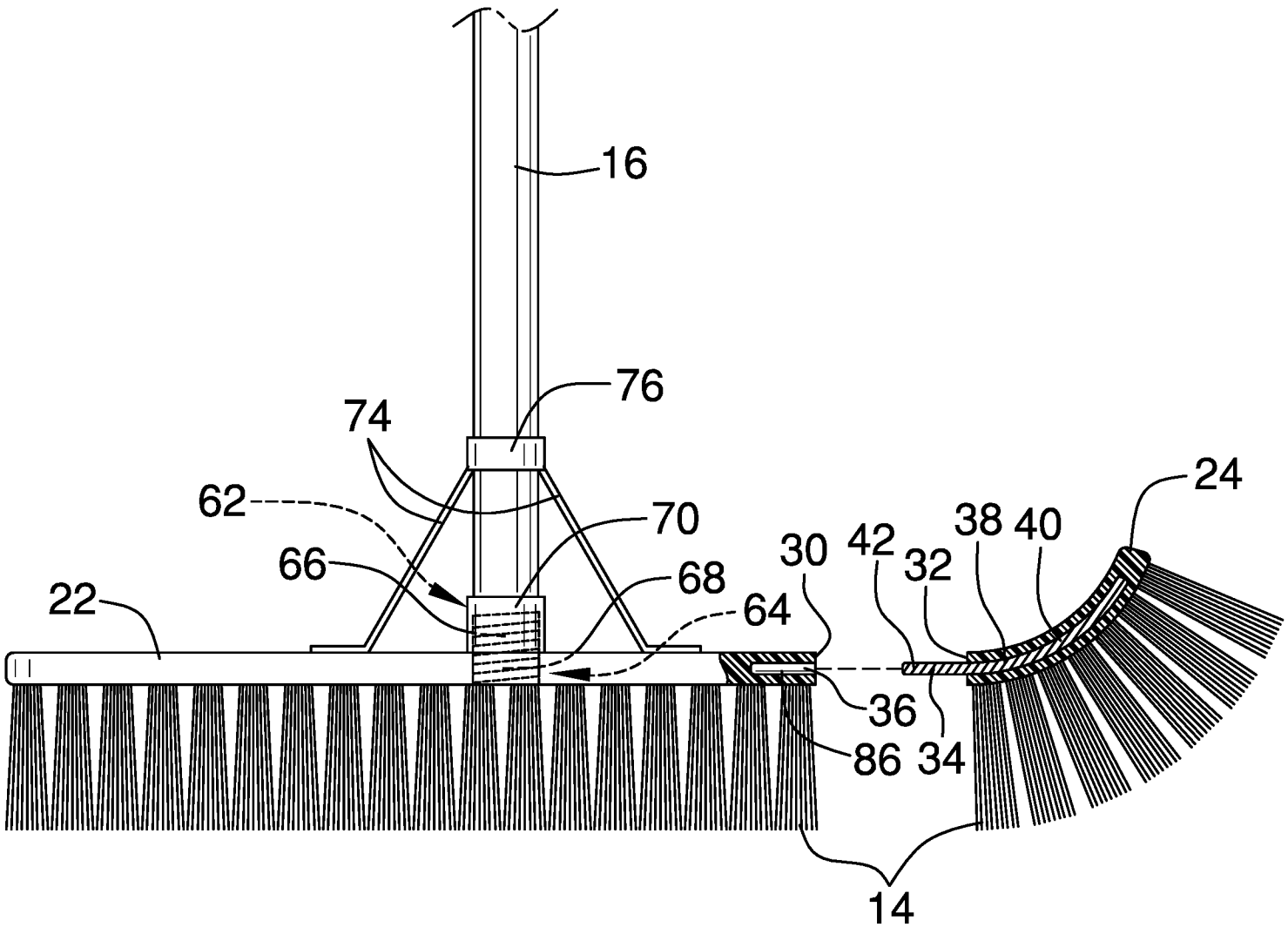
FIG. 3 is an exploded view of an embodiment of the disclosure.

The first connector 86 comprises a first slot 36 that is positioned in the first joining surface 30, as shown in FIG. 3. The second connector 34 comprises a slat 38 that is coupled to and extends from the second joining surface 32. The slat 38 is complementary to the first slot 36. The first slot 36 is positioned to selectively insert the slat 38 to removably couple the second section 24 to the first section 22. The slat 38 comprises metal. A second slot 40 is positioned in second joining surface 32. The slat 38 is positioned in the second slot 40 and is coupled to the second section 24 so that a segment 42 of the slat 38 extends from the second section 24, positioning the segment 42 to be inserted into the first slot 36 to removably couple the second section 24 to the first section 22.

The bristles 14 are coupled to and extend from a lower face 44 of the plate 12. The stick 16 is coupled to and extends from an upper face 46 of the plate 12. The stick 16 is configured to be grasped in hands of the user, positioning the user to urge the bristles 14 that are positioned on the first section 22 across a first surface with the bristles 14 that are positioned on the second section 24 configured to contact a second surface that is positioned substantially perpendicular to the first surface, allowing the user to collect debris that is positioned on the first surface. The device 10 is particularly suited to sweep residual grain from a floor of a grain bin. An advantage of the current invention is the ability to sweep along an edge of the floor of the bin without the plate 12 and bristles 14 hitting bolts that protrude from floor flashing that extends between the floor and a sidewall of the grain bin.

The stick 16 extends substantially perpendicularly from the plate 12 and is substantially centrally positioned on the plate 12. The stick 16 is circularly shaped when viewed longitudinally and comprises at least one of wood, metal, and plastic.

Figure 2:
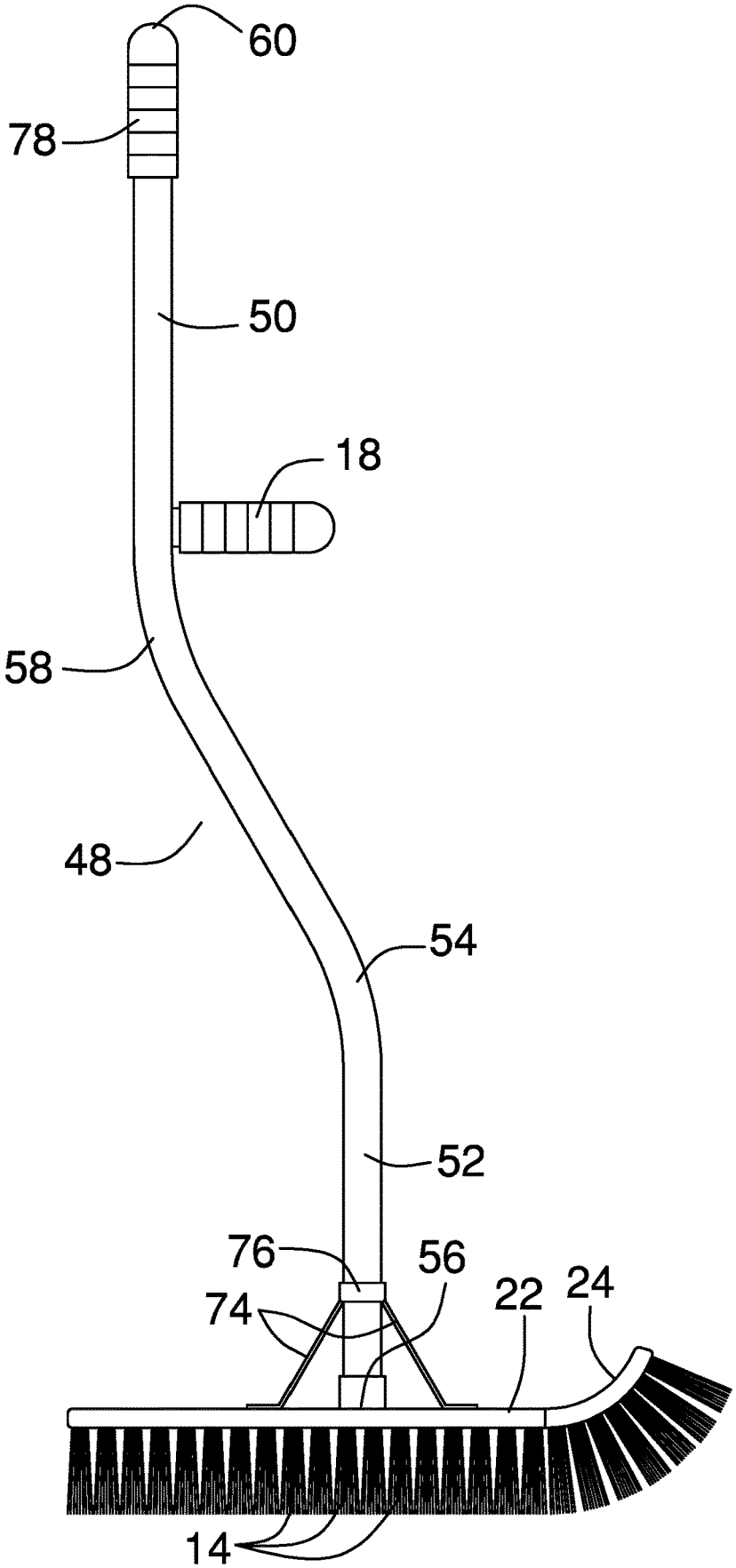
FIG. 2 is a front view of an embodiment of the disclosure.
Figure 6:
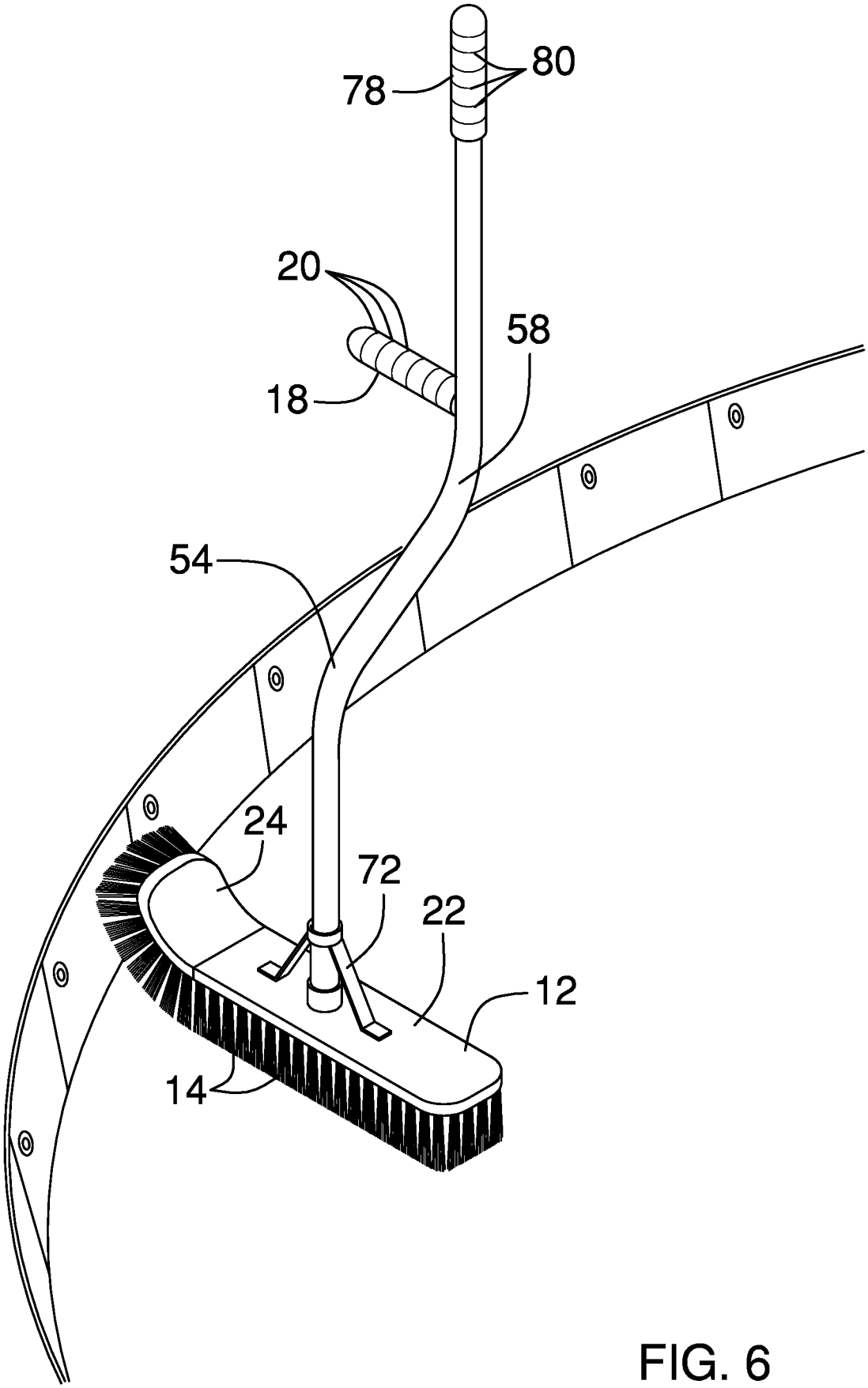
FIG. 6 is an in-use view of an embodiment of the disclosure.
Figure 7:
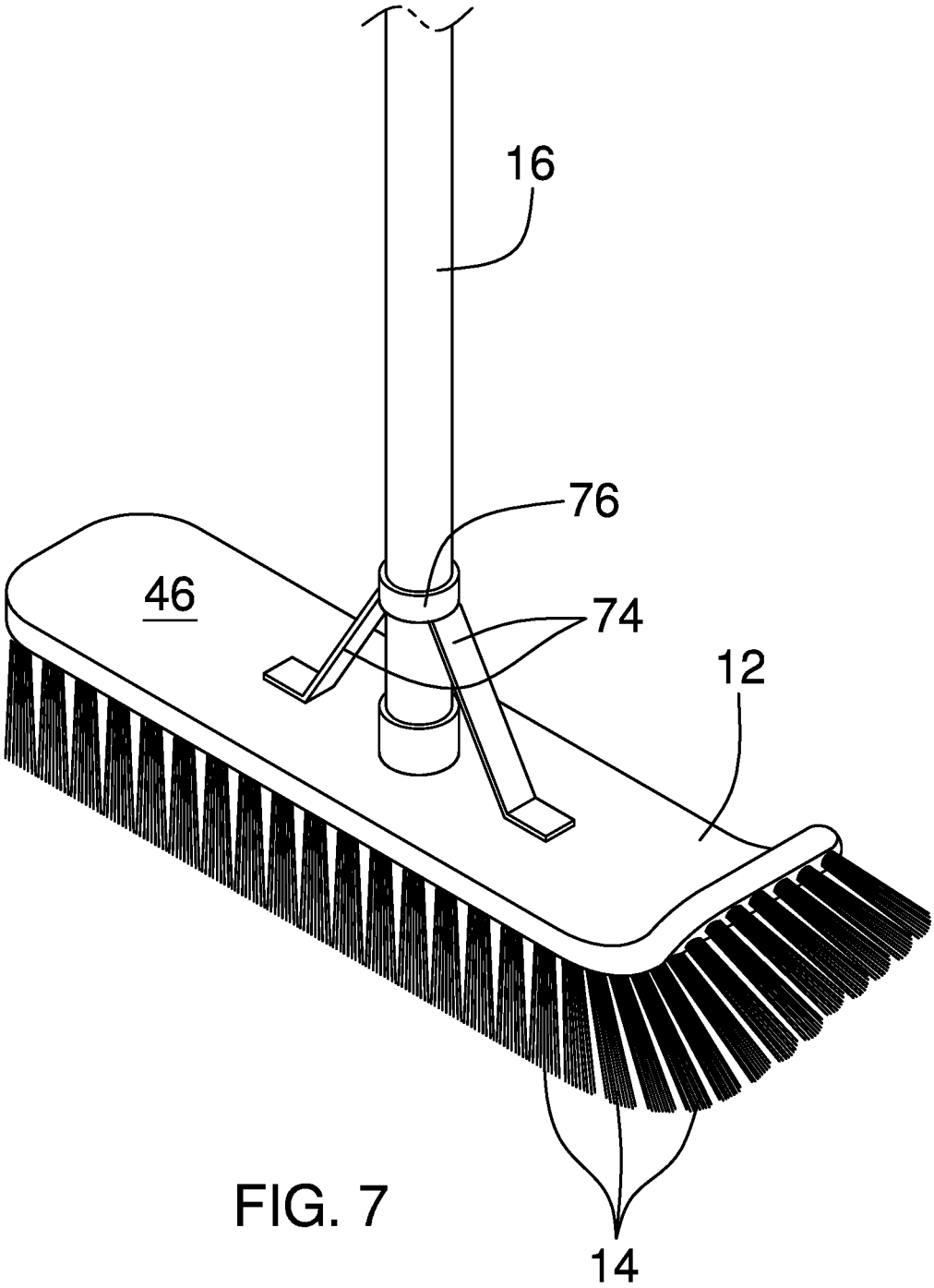
FIG. 7 is an isometric perspective view of an embodiment of the disclosure.

In yet another embodiment, as shown in FIGS. 2 and 6, an offset 48 is positioned in the stick 16 so that an upper section 50 of the stick 16 is substantially parallel to a lower section 52 of the stick 16 and so that the upper section 50 is positioned distal from the second section 24 of the plate 12 relative to the lower section 52 of the stick 16. The upper section 50 is configured to be grasped in the hands of the user, positioning the user to urge the bristles 14 that are positioned on the first section 22 across the first surface with the bristles 14 that are positioned on the second section 24 configured to contact the second surface to collect the debris that is positioned on the first surface.

The offset 48 comprises a first curve 54, which is positioned proximate to a first end 56 of the stick 16, and a second curve 58 that is positioned substantially equally distant from the first end 56 and a second end 60 of the stick 16. The offset 48 that is positioned in the stick 16 positions the user distal from the sidewall when sweeping along the edge of the floor, which is advantageous as the sidewall of a grain bin is typically curved.

A first coupler 62 is coupled to the first end 56 of the stick 16. A second coupler 64 is coupled to the plate 12. The second coupler 64 is complementary to the first coupler 62. The second coupler 64 is positioned to selectively couple to the first coupler 62 to removably couple the plate 12 to the stick 16. The first coupler 62 comprises threads 66 that are positioned on the stick 16 adjacent to the first end 56. The second coupler 64 comprises a channel 68 that extends into the plate 12 from the upper face 46. The channel 68 is internally threaded. The channel 68 is positioned to threadedly insert the first end 56 of the stick 16 to removably couple the stick 16 to the plate 12.

Figure 4:
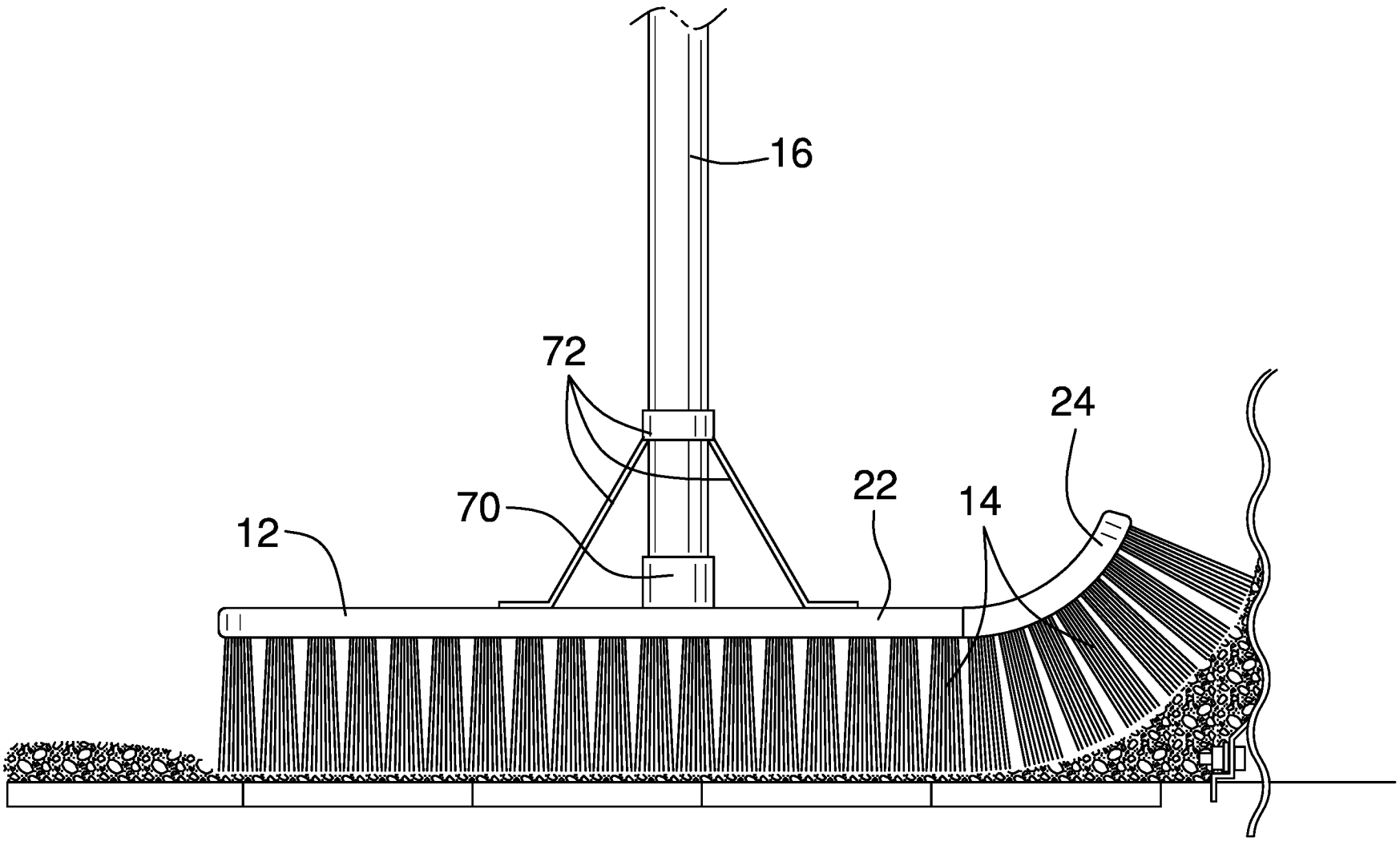
FIG. 4 is an in-use view of an embodiment of the disclosure.

The second coupler 64 also may comprise a tube 70 that is coupled to and extends from the upper face 46 of the plate 12, as shown in FIG. 4. The tube 70 is internally threaded and is positioned to threadedly insert the first end 56 of the stick 16 to removably couple the stick 16 to the plate 12.

A bracket 72 is coupled to and extends from the upper face 46 of the plate 12, as shown in FIG. 3. The bracket 72 is selectively couplable to the stick 16 to brace the stick 16 relative to the plate 12. The bracket 72 comprises a pair of bars 74, each of which is coupled to and extends transversely from the upper face 46 of the plate 12. A ring 76 is coupled to and extends between the bars 74 distal from the plate 12. The ring 76 is positioned around the stick 16 so that the ring 76 is positioned to brace the stick 16 relative to the plate 12.

Figure 8:
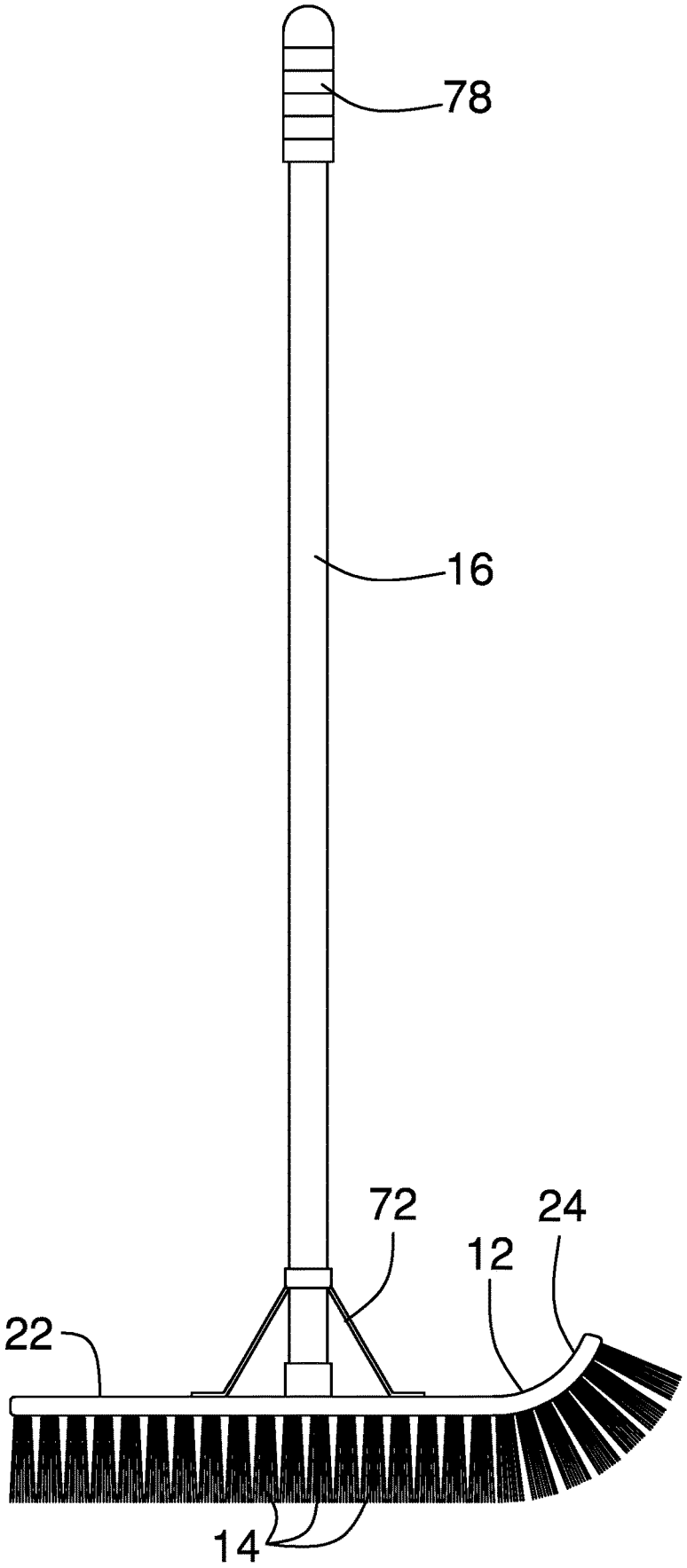
FIG. 8 is a front view of an embodiment of the disclosure.

A plurality of grips 78 is coupled to the stick 16, as shown in FIGS. 2, 6, and 8. Each grip 78 is configured to be grasped in a respective hand of the user to enhance a grasp of the hands on the stick 16. The plurality of grips 78 comprises a grip 78 that is coupled to the second end 60 of the stick 16. A plurality of indentations 80 is positioned in the grip. Each indentation 80 extends annularly around the grip 78 so that the indentations 80 are configured to enhance the grasp of the user on the grip.

A handle 18 is coupled to and extends substantially perpendicularly from the stick 16. As shown in FIGS. 2 and 6, the handle 18 is positioned on the upper section 50 of the stick 16 proximate to the second curve 58. The handle 18 extends from the stick 16 toward the second section 24 of the plate 12. A plurality of recesses 20 is positioned in the handle 18. Each recess 20 extends annularly around the handle 18 so that the recesses 20 are configured to enhance the grasp of the user on the handle 18.

Figure 5:
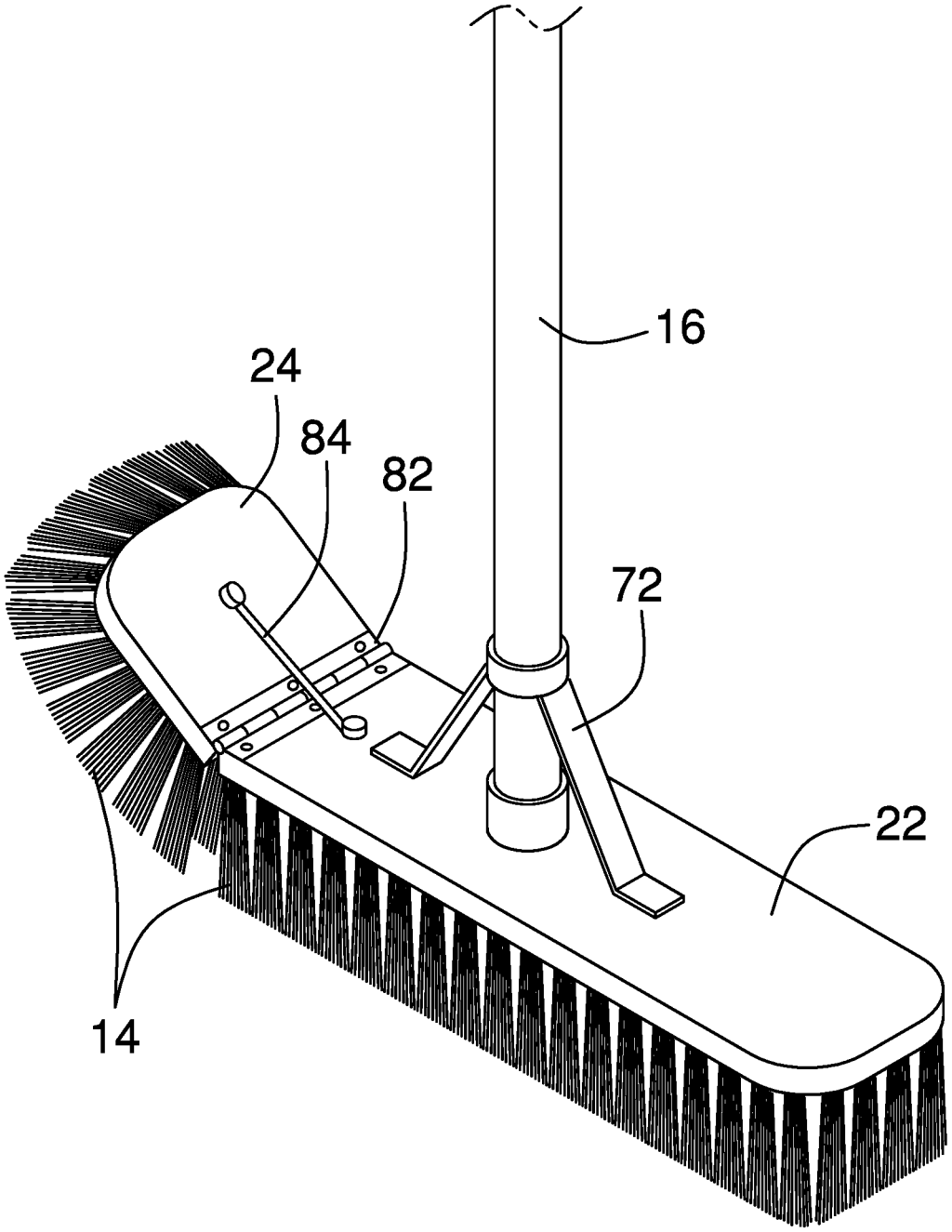
FIG. 5 is an isometric perspective view of an embodiment of the disclosure.

In still yet another embodiment, as shown in FIG. 5, both the first section 22 and the second section 24 of the plate 12 are planar. A hinge 82 is coupled to the upper face 46 of the plate 12 and extends between the first section 22 and the second section 24 so that the second section 24 is selectively pivotable relative to the first section 22. A rod 84 is selectively couplable to the upper face 46 of the plate 12 so that the rod 84 extends between the first section 22 and the second section 24 to selectively and fixedly position the second section 24 relative to the first section 22. An advantage of this embodiment is that the second section 24 is selectively pivotable to an angled configuration, to sweep along the edge of the floor, and a straight configuration to sweep a field of the floor.

In use, the stick 16 is grasped in the hands of the user, positioning the user to urge the bristles 14 on the first section 22 across a floor of a grain bin, with the bristles 14 on the second section 24 contacting the sidewall to collect the residual grain on the floor.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A debris collection device comprising:

a plate, the plate being elongated rectangularly shaped, the plate comprising a first section and second section of the plate, the first section being planar, the second section being curved;

a plurality of bristles coupled to and extending from a lower face of the plate;

a stick coupled to and extending from an upper face of the plate wherein the stick is configured for grasping in hands of a user positioning the user for urging the bristles positioned on the first section across a first surface with the bristles positioned on the second section configured for contacting a second surface positioned substantially perpendicular to the first surface for collecting debris positioned on the first surface;

an offset positioned in the stick such that an upper section of the stick is substantially parallel to a lower section of the stick and such that the upper section is positioned distal from the second section of the plate relative to the lower section of the stick wherein the upper section is configured for grasping in the hands of the user positioning the user for urging the bristles positioned on the first section across the first surface with the bristles positioned on the second section configured for contacting the second surface for collecting the debris positioned on the first surface, the offset comprising a first curve and a second curve, the first curve being positioned proximate to a first end of the stick, the second curve being positioned substantially equally distant from the first end and a second end of the stick; and a handle coupled to and extending substantially perpendicularly from the stick, the handle being positioned on the upper section of the stick proximate to the second curve, the handle extending from the stick toward the second section of the plate, the handle having a distal end relative to the stick, the handle having a length less than a measurement of offset between the upper section and lower section of the stick wherein the distal end of the handle is positioned vertically spaced above the offset and between respective central longitudinal axes of the upper section and the lower section.

2. The device of claim 1, further including the stick extending substantially perpendicularly from the plate.

3. The device of claim 1, further comprising:

the stick being substantially centrally positioned on the plate, the stick being circularly shaped when viewed longitudinally; and the plate having corners, the corners being arcuate.

4. The device of claim 1, further including the stick and the plate each comprising at least one of wood, metal, and plastic.

5. The device of claim 1, further comprising:

a separation positioned between the second section and the first section of the plate defining a first joining surface positioned on the first section and a second joining surface positioned on the second section;

a first connector coupled to the first joining surface; and a second connector coupled to the second joining surface, the second connector being complementary to the first connector such that the second connector is positioned for reversibly coupling to the first connector for removably coupling the second section to the first section.

6. The device of claim 5, further comprising:

the first connector comprising a first slot positioned in the first joining surface; and the second connector comprising a slat coupled to and extending from the second joining surface, the slat being complementary to the first slot wherein the first slot is positioned for selectively inserting the slat for removably coupling the second section to the first section.

7. The device of claim 6, further comprising:

the slat comprising metal; and a second slot positioned in second joining surface, the slat being positioned in the second slot and coupled to the second section such that a segment of the slat extends from the second section positioning the segment for inserting into the first slot for removably coupling the second section to the first section.

8. The device of claim 1, further comprising:

a first coupler coupled to a first end of the stick; and a second coupler coupled to the plate, the second coupler being complementary to the first coupler wherein the second coupler is positioned for selectively coupling to the first coupler for removably coupling the plate to the stick.

9. The device of claim 8, further comprising:

the first coupler comprising threads positioned on the stick adjacent to the first end; and the second coupler comprising a channel extending into the plate from the upper face, the channel being internally threaded wherein the channel is positioned for threadedly inserting the first end of the stick for removably coupling the stick to the plate.

10. The device of claim 9, further including the second coupler comprising a tube coupled to and extending from the upper face of the plate, the tube being internally threaded wherein the tube is positioned for threadedly inserting the first end of the stick for removably coupling the stick to the plate.

11. The device of claim 1, further including a bracket coupled to and extending from the upper face of the plate, the bracket being selectively couplable to the stick for bracing the stick relative to the plate, the bracket comprising a pair of bars and a ring, each bar being coupled to and extending transversely from the upper face of the plate, the ring being coupled to and extending between the bars distal from the plate, the ring being positioned around the stick such that the ring is positioned for bracing the stick relative to the plate.

12. The device of claim 1, further including a plurality of grips coupled to the stick wherein each grip is configured for grasping in a respective hand of the user for enhancing a grasp of the hands on the stick.

13. The device of claim 12, further including the plurality of grips comprising a grip coupled to a second end of the stick.

14. The device of claim 12, further including a plurality of indentations positioned in the grip, each indentation extending annularly around the grip wherein the indentations are configured for enhancing the grasp of the user on the grip.

15. The device of claim 1, further including a plurality of recesses positioned in the handle, each recess extending annularly around the handle wherein the recesses are configured for enhancing the grasp of the user on the handle.

16. A debris collection device comprising:

a plate, the plate being elongated rectangularly shaped, the plate comprising a first section and second section of the plate, the first section being planar, the second section being curved, the plate having corners, the corners being arcuate, the plate comprising at least one of wood, metal, and plastic;

a separation positioned between the second section and the first section of the plate defining a first joining surface positioned on the first section and a second joining surface positioned on the second section;

a first connector coupled to the first joining surface, the first connector comprising a first slot positioned in the first joining surface;

a second connector coupled to the second joining surface, the second connector being complementary to the first connector such that the second connector is positioned for reversibly coupling to the first connector for removably coupling the second section to the first section, the second connector comprising a slat coupled to and extending from the second joining surface, the slat being complementary to the first slot wherein the first slot is positioned for selectively inserting the slat for removably coupling the second section to the first section, the slat comprising metal;

a second slot positioned in second joining surface, the slat being positioned in the second slot and coupled to the second section such that a segment of the slat extends from the second section positioning the segment for inserting into the first slot for removably coupling the second section to the first section;

a plurality of bristles coupled to and extending from a lower face of the plate;

a stick coupled to and extending from an upper face of the plate wherein the stick is configured for grasping in hands of a user positioning the user for urging the bristles positioned on the first section across a first surface with the bristles positioned on the second section configured for contacting a second surface positioned substantially perpendicular to the first surface for collecting debris positioned on the first surface, the stick extending substantially perpendicularly from the plate, the stick being substantially centrally positioned on the plate, the stick being circularly shaped when viewed longitudinally, the stick comprising at least one of wood, metal, and plastic;

an offset positioned in the stick such that an upper section of the stick is substantially parallel to a lower section of the stick and such that the upper section is positioned distal from the second section of the plate relative to the lower section of the stick wherein the upper section is configured for grasping in the hands of the user positioning the user for urging the bristles positioned on the first section across the first surface with the bristles positioned on the second section configured for contacting the second surface for collecting the debris positioned on the first surface, the offset comprising a first curve and a second curve, the first curve being positioned proximate to a first end of the stick, the second curve being positioned substantially equally distant from the first end and a second end of the stick;

a first coupler coupled to the first end of the stick, the first coupler comprising threads positioned on the stick adjacent to the first end;

a second coupler coupled to the plate, the second coupler being complementary to the first coupler wherein the second coupler is positioned for selectively coupling to the first coupler for removably coupling the plate to the stick, the second coupler comprising a channel extending into the plate from the upper face, the channel being internally threaded wherein the channel is positioned for threadedly inserting the first end of the stick for removably coupling the stick to the plate;

a bracket coupled to and extending from the upper face of the plate, the bracket being selectively couplable to the stick for bracing the stick relative to the plate, the bracket comprising:

a pair of bars, each bar being coupled to and extending transversely from the upper face of the plate, and a ring coupled to and extending between the bars distal from the plate, the ring being positioned around the stick such that the ring is positioned for bracing the stick relative to the plate;

a plurality of grips coupled to the stick wherein each grip is configured for grasping in a respective hand of the user for enhancing a grasp of the hands on the stick, the plurality of grips comprising a grip coupled to the second end of the stick;

a plurality of indentations positioned in the grip, each indentation extending annularly around the grip wherein the indentations are configured for enhancing the grasp of the user on the grip;

a handle coupled to and extending substantially perpendicularly from the stick, the handle being positioned on the upper section of the stick proximate to the second curve, the handle extending from the stick toward the second section of the plate, the handle having a distal end relative to the stick, the handle having a length less than a measurement of offset between the upper section and lower section of the stick wherein the distal end of the handle is positioned vertically spaced above the offset and between respective central longitudinal axes of the upper section and the lower section; and a plurality of recesses positioned in the handle, each recess extending annularly around the handle wherein the recesses are configured for enhancing the grasp of the user on the handle.

17. The device of claim 16, further including the second coupler comprising a tube coupled to and extending from the upper face of the plate, the tube being internally threaded wherein the tube is positioned for threadedly inserting the first end of the stick for removably coupling the stick to the plate.

* * * * *